US005915520A

United States Patent [19]

Goodrich

[11] Patent Number: 5,915,520

[45] Date of Patent: Jun. 29, 1999

[54] COUNTERFEIT COIN SEPARATOR

[75] Inventor: Robert Ray Goodrich, Marion County, Ind.

[73] Assignee: Lucent Technologies Inc., Murray Hill, N.J.

[21] Appl. No.: 08/882,682

[22] Filed: Jun. 25, 1997

[51] Int. Cl.[6] ..... G07F 1/04

[52] U.S. Cl. ..... 194/346

[58] Field of Search ..... 194/203, 317, 194/318, 319, 346

[56] References Cited

U.S. PATENT DOCUMENTS 1,933,686 11/1933 Sharpnack ..... 194/203

FOREIGN PATENT DOCUMENTS 856 787 12/1960 United Kingdom ..... 194/346

*Primary Examiner*—F. J. Bartuska

[57] ABSTRACT

A coin separation apparatus is positioned in a coin slot chute through which a deposited coin may fall. Electronic apparatus advantageously determines whether the falling coin is genuine or counterfeit. If the coin is determined to be genuine, the electronic apparatus activates a solenoid which unlocks a door to a coin box safe. The falling coin first strikes a vane of a hinged diverter door and the kinetic energy of the coin causes the diverter door to rotate on its hinge. The diverter door is spring-coupled to the door of the coin box safe which, if unlocked, is caused to open by the rotating diverter door, thereby permitting the coin to enter the coin box safe. If the electronic apparatus fails to detect that the falling coin is genuine, the solenoid is not activated and the coin box safe door remains locked. The falling coin strikes the vane of the diverter door causing it to rotate on its hinge and stretching the spring and allowing the coin to fall out of the chute. The kinetic energy of the falling coin is dissipated in both the inertia of the rotating diverter door and in the spring coupling, without opening the door to the coin box safe.

6 Claims, 2 Drawing Sheets

COUNTERFEIT COIN SEPARATOR

FIELD OF THE INVENTION

This invention relates to coin fraud protection and, more particularly, to the separation of good from counterfeit coins.

BACKGROUND OF THE INVENTION

Heretofore electronic apparatus has been devised for detecting counterfeit coins deposited in a coin slot while the coins are falling through a coin chute. When a counterfeit coin is detected it is desirable to both deny the depositor the service normally accorded to a customer and to prevent the counterfeit coin from being deposited in the coin box safe into which genuine coins are to be collected. While the denial of service is easily accomplished by a signal generated from the electronic counterfeit coin detecting apparatus, the separation of the counterfeit coin from the stream of genuine coins requires a physical action that must be completed while the counterfeit coin is falling through the coin chute and before the coin is wrongfully deposited into the coin box safe for genuine coins.

SUMMARY OF THE INVENTION

In accordance with the principles of the present invention, in one illustrative embodiment thereof, a coin slot chute is provided through which coins deposited in the slot may fall. Electronic apparatus determines whether the falling coin is genuine or counterfeit. If the coin is determined to be genuine, the electronic apparatus activates a solenoid which unlocks the door in the path to the coin box safe. The falling coin first strikes a hinged diverter door positioned above the coin box safe door and the kinetic energy of the falling coin causes the diverter door to be rotated on its hinge. The diverter door is spring coupled to the coin box door which, if unlocked by the activated solenoid, is caused to open by the rotating diverter door, thereby permitting the coin to enter the path to the coin box safe. If the electronic apparatus fails to detect that the falling coin is genuine, the solenoid is not activated and the coin box safe door remains locked. The falling coin strikes the diverter door which rotates about its hinge allowing the coin to fall out of the chute. The kinetic energy of the falling coin is dissipated in both the inertia of the rotating diverter door and in the spring coupling, without opening the door to the coin box safe.

DESCRIPTION OF THE DRAWING

The foregoing and other features of the invention may be better understood from the ensuing description when read together with the drawing, in which.

GENERAL DESCRIPTION

Figure 1:
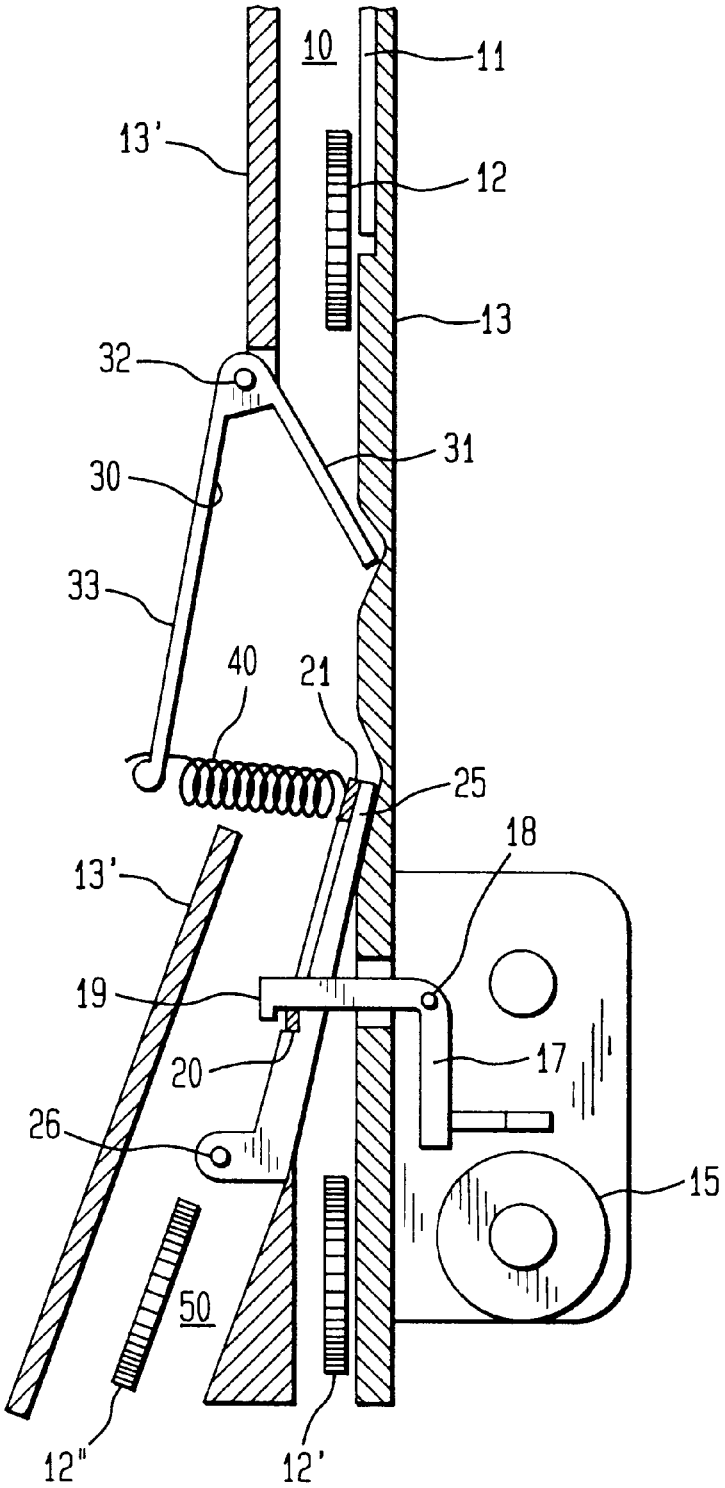
FIG. 1 shows a side view of an illustrative coin chute having the spring-coupled diverter and coin box safe doors.
Figure 2:
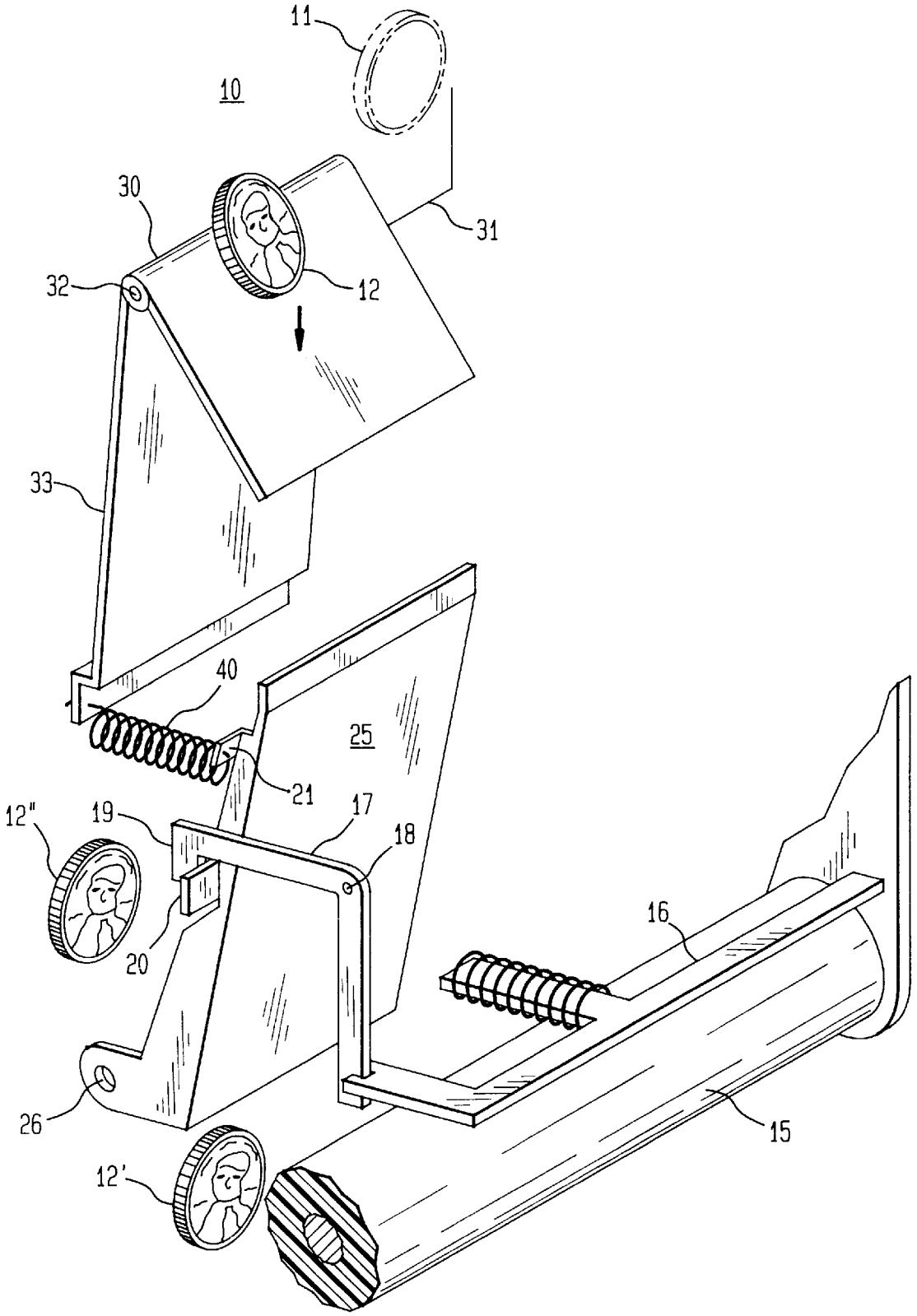
FIG. 2 is an isometric view of the apparatus of FIG. 1 showing the positions of genuine and counterfeit coins.

Referring now to FIG. 1 there is positioned in a coin chute 10, defined by walls 13, 13', electronic coin sensing apparatus 11 that determines whether a coin 12 falling through chute 10 is genuine or counterfeit. If apparatus 11 determines that the falling coin is genuine, it operates solenoid 15. Solenoid 15 actuates armature 16 connected to one arm of bellcrank 17 causing bellcrank 17 to rotate clockwise about pin 18. The lefthand arm of bellcrank 17 terminates in hook member 19. When bellcrank 17 is so rotated by armature 16, hook member disengages from detent 20, freeing the hinged coin gate or door 25 for rotation about hinge pin 26. Coin 12 falling through chute 10 eventually reaches the coin diverter vane or door 30. Coin diverter door 30 includes a deflecting vane portion 31 located above hinge pin 32 and an actuating vane portion 33 located below hinge pin 32. When the falling coin strikes deflecting vane portion 31, door 30 is caused to rotate clockwise about pin 32. Actuating vane portion 33 is coupled by spring linkage 40 to tab 21 of coin gate 25. Clockwise rotation of diverter door 30 causes actuating vane portion 33 to exert a leftward pull on spring linkage 40, drawing with it coin gate 25. With coin gate 25 drawn leftward, coin 12, now shown at 12', is free to enter the coin collection chute where it is retained in a coin safe (not shown).

If, however, a counterfeit coin is dropped into chute 10, coin sensing apparatus 11 will not actuate solenoid 15 and bellcrank 17 will not be released from detent 20, thereby securing coin gate 25 against rotation about pin 26. The falling coin striking deflecting vane portion 31 of coin diverter door 30 causes door 30 to rotate about pin 32 stretching spring linkage 40 whose right-hand end is secured to coin gate 25. Gate 25 remains locked against movement. The energy of the falling coin is sufficient, however, to stretch spring linkage enough to allow the falling coin, now shown at 12", to enter the reject chute 50, where it may be disposed of as desired.

The kinetic energy of a falling coin having a mass $m_c$ which reaches a velocity $v_c$ when it strikes the diverter vane 31 is given by $\frac{1}{2}(m_c v_c^2)$. The kinetic energy dissipated in moving the coin diverter door 30 having a moment of inertia of $I_a$ and an average angular rotational speed of $\omega_a$ is given by $\frac{1}{2}(I_a \omega_a^2)$. The kinetic energy dissipated in the coin path safe door 25 having a moment of inertia $I_g$ and an average angular rotational velocity $\omega_g$ is given by $\frac{1}{2}(I_g \omega_g^2)$. The kinetic energy dissipated in moving the spring having a mass $m_s$, a spring constant k and an average velocity $v_s$ is given by $\frac{1}{2}(m_s v_s^2)$. The kinetic energy of the falling coin, $\frac{1}{2}(m_c v_c^2)$, must be greater than the sum of $\frac{1}{2}(I_a \omega_a^2)+\frac{1}{2}(I_g \omega_g^2)+\frac{1}{2}(m_s v_s^2)+m_a g \Delta h_a$, where $m_a$ is the mass of diverter door 30, g is the acceleration of gravity, and $\Delta h_a$ is the vertical component of the movement of the center of mass of coin gate door 25. This is equal to $m_a g \Delta h_a + k/2(\theta_a d_5 - \theta_g d_2)$, where $\theta_a$ is the angle through which diverter door 30 is caused to be rotated, $d_5$ is the vertical distance through which the center of mass of door 30 is moved, $\theta_g$ is the angle through which coin gate door 25 is rotated, and $d_2$ is the vertical distance through which the center of mass of coin gate door is moved. For the coin diverter door to reject counterfeit coins (solenoid 15 not energized), the kinetic energy of the falling coin must at least equal $\frac{1}{2}(I_a \omega_a^2)+F_s k\, dx$, where dx is the distance the spring is extended by the rotating diverter door and $F_s$ is the initial spring tension. For the lightest coin to be rejected, the initial spring tension $F_s$ should be set to a minimum.

What has been described is deemed to be illustrative of the principles of the invention, but certain modifications may be apparent. For example, it is the customary practice to allow a coin entering reject chute 50 to fall free of the apparatus rather than to be confiscated. Where the apparatus is suitably protected against vandalism, the counterfeit coin may be retained and a counterfeit coin signal (not shown) may be displayed to inform the user that the coin had been confiscated. Numerous modifications may be made by those skilled in the art without, however, departing from the spirit and scope of the invention.

What is claimed is:

1. A counterfeit coin separation apparatus for steering a coin falling in a coin chute to a coin collection safe or to a reject path comprising a coin path safe door positioned in said coin chute and lockable to block entry to said coin collection safe from said coin chute;

a coin diverter door positioned in said coin chute, said door being adapted to receive the kinetic energy of said falling coin; and linkage coupling said coin diverter door to said coin path safe door, said linkage being adapted to open said coin path safe door when unlocked in response to said coin diverter door receiving the kinetic energy from said falling coin and permitting said coin to fall free of said coin safe and through said reject chute when said coin safe door is locked.

2. A counterfeit coin separation apparatus according to claim 1 wherein said coin path safe door is electrically unlockable.

3. A counterfeit coin separation apparatus for steering a coin falling in a coin chute to a coin safe or to a reject path comprising a coin safe door positioned in said coin chute, said coin safe door being openable to allow deposit of a falling coin into said coin safe and being lockable to block entry to said coin safe from said coin chute;

a coin safe door locking arm normally locking said coin safe door; said locking arm being electrically releasable in response to the detection of a genuine coin in said chute;

a coin diverter door positioned in said coin chute, said door being adapted to receive the energy of said falling coin;

linkage coupling said coin diverter door to said coin safe door, said linkage being adapted to open said coin safe door when unlocked in response to said coin diverter door receiving the kinetic energy of said falling coin and permitting said coin to fall free of said coin safe and through said reject chute when said coin safe door is locked.

4. A counterfeit coin separation apparatus according to claim 3 wherein said coin diverter door includes a first and a second vane, said first vane situated in the path of said falling coin and wherein said linkage includes said second vane and a spring coupling said second vane to said coin safe door.

5. A counterfeit coin separation apparatus according to claim 4 wherein said coin diverter door is hinged about a pin situated between said first and said second vane.

6. A counterfeit coin separation apparatus for use in a coin drop channel positioned above a coin collection channel, comprising:

a first and a second door hingably mountable in said coin drop channel, said first door being adapted to partially block the path of a coin falling through said coin drop channel, said second door being lockable and unlockable;

spring linkage coupling said first door to said second door, said spring linkage being adapted to pull open said second door when unlocked to permit said falling coin striking said first door to fall into said coin collection channel and said spring linkage being stretchable when said second door is locked to permit said first door to unblock said path to allowing said coin to fall clear of said coin collection channel.

* * * * *